United States Patent [19]

Ishii

[11] Patent Number: 4,603,239

[45] Date of Patent: Jul. 29, 1986

[54] CASH DRAWER ASSEMBLY HAVING A COMPULSORY SWITCH ACTIVATING DRAWER LATCH

[75] Inventor: Shiro Ishii, Garden Grove, Calif.

[73] Assignee: M-S Cash Drawer, Stanton, Calif.

[21] Appl. No.: 751,973

[22] Filed: Jul. 5, 1985

[51] Int. Cl.[4] ..... H01H 3/16

[52] U.S. Cl. ..... 200/61.61; 200/61.62; 235/22

[58] Field of Search ..... 200/61.61, 61.62; 235/22

[56] References Cited

U.S. PATENT DOCUMENTS

| | | | |
|---|---|---|---|
| 2,276,632 | 3/1942 | Stelter et al. | 200/61.61 X |
| 3,628,724 | 12/1971 | Showers, Jr. | 235/22 |
| 3,855,432 | 12/1974 | Kelly et al. | 200/61.61 |
| 4,101,745 | 7/1978 | Smith | 200/61.61 |
| 4,182,539 | 1/1980 | Busch | 235/22 X |
| 4,424,426 | 1/1984 | Ishii | 200/61.61 |

OTHER PUBLICATIONS

Berkman, J. W.; IBM Tech. Disc. Bull.; "Multiple Cash Drawer Control"; vol. 10, No. 12, May 1968, pp. 1928, 1929.

Best, J. J. et al; IBM Tech. Disc. Bull.; "Self-14 Restoring Latch/Unlatch Mechanism for Logic Controlled Drawer"; vol. 17, No. 7, Dec. 1974, pp. 1846, 1847.

Burnham, D. W.; IBM Tech. Disc. Bull.; "Release Mechanism for Spring Loaded Drawer"; vol. 14, No. 12, May 1972, pp. 3659.

Stokes, W. W., Jr.; IBM Tech. Disc. Bull.; "Adjustable Profile Latch"; vol. 21, No. 10, Mar. 1979, pp. 4144, 4145.

*Primary Examiner*—J. R. Scott

*Attorney, Agent, or Firm*—Wenderoth, Lind & Ponack

[57] ABSTRACT

A compulsory switch activating latch for being fixed to the casing of a cash drawer. The latch includes a pivotable latch member for engaging a latch bar on the drawer. The pivotable latch member is also capable of limited reciprocal movement in the direction of movement of the drawer in and out of the casing. A spring between the drawer and casing urges the drawer, latch bar and pivotable latch member in the outward direction of the drawer when the latch bar is locked in the pivotable latch member. A detector is provided for detecting such movement of the movable latch member, whereby the locked condition of the pivotable latch member is detected with certainty. In the preferred embodiment, the detector includes a slidable switch member in contact with the lever of a lever microswitch, and is positioned so as to be moved by the pivotable latch member to close the microswitch when the pivotable latch member is moved outward by the spring between the drawer and casing.

16 Claims, 18 Drawing Figures

CASH DRAWER ASSEMBLY HAVING A COMPULSORY SWITCH ACTIVATING DRAWER LATCH

BACKGROUND OF THE INVENTION

1. Field of the Invention

The invention relates to an electrically opening cash drawer latch, and more particularly, to such a latch which provides an electrical signal indicative of whether the latch is open or closed.

2. Prior Art

A prior cash drawer latch invented by the inventor and disclosed in U.S. Pat. No. 4,424,426, is opened with electrical power from a D. C. battery. When such a cash drawer is associated with a computerized cash register, it is known to automatically detect and record each opening and closing of the cash drawer by detecting opening and closing of the drawer latch, wherein the state of an electrical switch is changed by the latch each time it opens or closes. However, in this prior device, the arrangement of the latch and switch are such as to be necessarily prone to detect a drawer closing prior to complete closing of the latch. This can give rise to false indications of drawer closing. If a false indication of closing of the latch is recorded, as for example, if a partial but incomplete closing of the drawer and latch activate a change in the state of the switch, and then the drawer is pulled open, the drawer is recorded as closed even though it is open. Under these circumstances, unauthorized removal of money from the cash drawer is facilitated.

It is an object of the invention to provide a cash drawer assembly which includes a compulsory switch activating drawer latch which detects a drawer closing only when the latch is definitely closed and the drawer is therefore completely latched closed.

SUMMARY OF THE INVENTION

In accordance with one aspect of the invention, there is provided cash drawer having a latching arrangement for locking the drawer closed and a switch arrangement which detects complete locking of the latch in a fail-safe manner. A pivotable latch member mounted to the casing is engagable with a rigid latch member fixed on the drawer tray as the drawer is closed. As the drawer is closed, the drawer tray latch member engages a hook portion of the pivotable latch member to pivot the pivotable latch member into a locked state in which the fixed latch member is held in the hook portion. When the pivotable and fixed latch members are in a locked state (the drawer being completely closed), a spring which resiliently biases the drawer tray toward an open position and which causes the drawer tray to spring open when the latch arrangement is open, applies a longitudinally force on the pivotable latch member through the fixed latch member. The pivotable latch member is mounted to the casing so as to be reciprocally moveable over a short distance in the longitudinally direction of movement of the drawer tray in and out of the casing. Spring means are provided for resiliently biasing the pivotable latch member in the direction of movement of the drawer tray into the casing. When the fixed latch member is not engaged with the pivotable latch member, that is, when the drawer tray is not locked in the casing, this spring means maintains the pivotable latch member in its longitudinally outermost position. On the other hand, when the fixed latch member is locked in the hook portion of the pivotable latch member, that is, when the drawer is completely closed, the spring which springs the drawer tray out of the casing when the drawer is open, urges the pivotable latch member (through the fixed latch member and the drawer tray) to its longitudinally outermost position against the bias of the above-mentioned spring means. Means are also provided for detecting the longitudinal position of the pivotable latch member. When the pivotable latch member is in its longitudinally outermost position, the latch members are assuredly locked and the drawer is completely closed. When the pivotable latch member is in its innermost position, the latch members are assuredly not locked and the drawer is thus open or, in any case, not completely closed and locked. Thus, by detecting the longitudinal position of the pivotable latch member, the state of locking of the latch member is accurately detected.

In accordance with another aspect of the invention, the detecting means includes a switching member mounted to the casing so as to be reciprocally moveable between first and second positions. In its first position, the switching member depresses the lever of a lever microswitch; in its second position, the lever is not depressed. A projection fixed to the pivotable latch member is located to engage a hook portion of the switching member and to displace the switching member when the pivotable latch member is moved from its inner to its outer position, thereby causing the lever of the microswitch to be depressed. When the drawer assembly is actuated to unlock the pivotable latch member so as to release the fixed latch member from its hook portion, the pivotable latch member is pivoted by the retracting fixed latch member under the influence of the above-mentioned drawer opening spring, whereby the projection from the pivotable latch member pivots out of the hook portion of the switching member and the switching member is free to move to its second position under the influence of the spring force of the microswitch lever. Thus, the microswitch lever is only depressed when the fixed latch member is locked in the pivotable latch member. Thus, signals from the microswitch provide a fail-safe indication of whether the drawer is completely closed, that is, whether the drawer tray is locked in the casing by the pivotable and fixed latch members.

BRIEF DESCRIPTION OF THE DRAWINGS

These and other aspects and advantages of the invention may be more fully understood from the following detailed description of a preferred embodiment when taken with the accompanying drawings in which.

DETAILED DESCRIPTION OF THE PREFERRED EMBODIMENT

Figure 1:
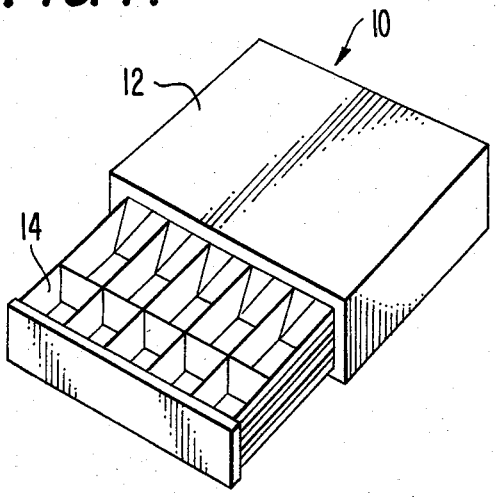
FIG. 1 is a perspective view of the cash drawer in accordance with the present invention.

Referring first to FIG. 1, there is shown a perspective view of a cash drawer 10 having a casing 12 for a drawer tray 14. The cash drawer is closed manually and may be open with the aid of a remote control switch (not shown in the drawings) coupled to a latching mechanism inside the cash drawer powered, for example, by a battery (not shown in the drawings).

Figure 2:
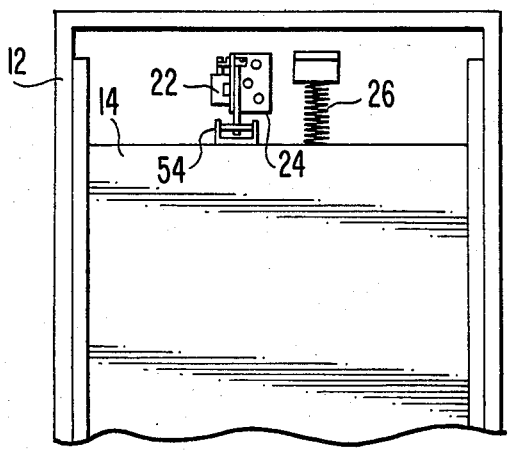
FIG. 2 is a bottom view of a portion of the cash drawer shown in FIG. 1 with the bottom surface of the cash drawer casing removed for cla

Referring now to FIG. 2, the latching mechanism includes a solenoid 22 mounted to casing 12. The source of power-to energize solenoid 22 may vary according to the application. Solenoid 22 is a component of a drawer latch assembly 24 for holding drawer tray 14 inside casing 12. Also shown in FIG. 2 is a push spring 26 mounted between a rear portion of casing 12 and a rear panel of drawer tray 14 in order to urge the drawer tray 14 from casing 12 when the latch assembly 24 is in a state of disengagement (unlocked).

Figure 3:
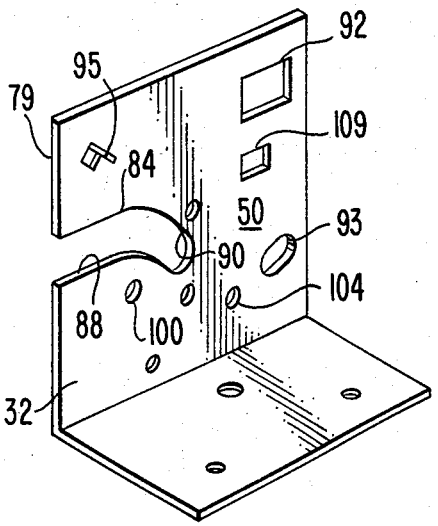
FIG. 3 is a mounting bracket in accordance with the present invention.

FIG. 3 illustrates an L-shaped bracket 32 which is fixed to the base of the casing 12 and on which the principle elements of the compulsory switch activating latch are mounted. The bracket 32 has a slot 84 opening into the front edge 79. Slot 84 includes a horizontally extending front portion 88 and a downwardly curved rear portion 90. Bracket 32 also has an integrally formed projection 95 suitably punched outwardly therefrom above portion 88 of slot 84 extending outwardly of surface 50. The upper rear portion of bracket 3 has a generally rectangular opening 92. Below the opening 92 in the bracket 32 is another slot 93. A still further small slot 93 is provided generally centrally in the bracket 32.

Figure 6:
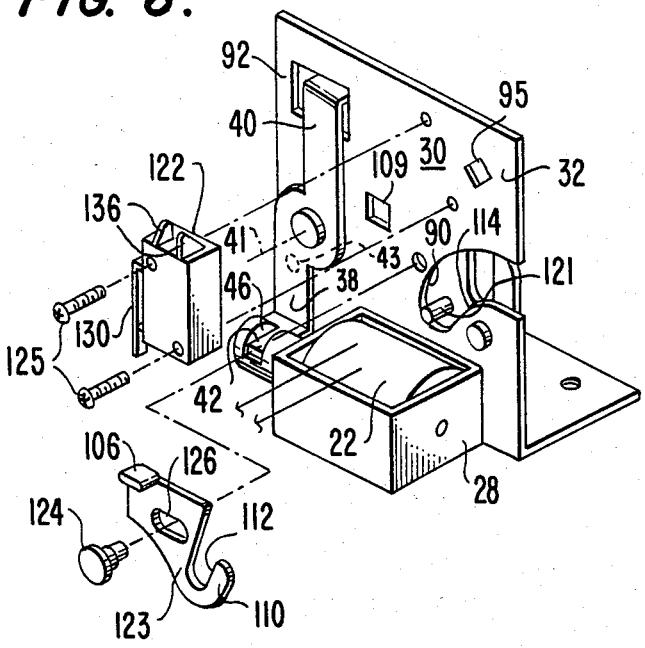
FIG. 6 is an exploded view of the other side of the compulsory switch activating latch in accordance with the present invention.

Referring to FIG. 6, solenoid 22 is mounted in a casing 28 which is in turn fixed to the vertical side 30 of L-shaped bracket 32. The L-shaped bracket 32 pivotally supports latch members 34 and 36 of latch assembly 24 as will be explained below.

Latch member 34 is a latch lever release arm which is pivotally mounted to side 30 of bracket 32 and includes extended portions 38 and 40 extending vertically in opposite directions along parallel lines on opposite sides of its axis of rotation 41. The bottom end of the extended portion 38 has a pin 42 extending outwardly thereof pivotally mounted in a vertical slot 46 in solenoid plunger 44 which is mounted to solenoid casing 28 so as to be drawn inward by the solenoid 22 when the solenoid is energized. Accordingly, when solenoid 22 is energized, solenoid plunger 44 is drawn inwardly with engaging pin 42 to rotate latch lever release arm 34 about its axis of rotation 41. An end portion 48 of extended portion 40 of latch lever release arm 34 extends in a direction opposite that of pin 42 through opening 92 in bracket 32 to engage a portion of pivotable latch member 36 as will be described.

Between the pin 42 and axis 41, a pin 43 fixed to extended portion 38 extends oppositely to pin 42 through slot 93 so as to be freely reciprocal therein when the latch member 34 pivots, and so as to be engageable with pivotable latch member 36 as will also be described (see FIGS. 5 and 6). Also mounted to side 30 is a lever microswitch 122 having terminal 136 for external connection to, for example, a computerized cash register. Microswitch 122 has a pivotable lever 130 which is biased outward by an internal spring means of a switch contact 127 and may be pivoted inward by a horizontally reciprocally moveable switching member 123 which is mounted to side 30 of bracket 32 as will be explained in greater detail below. Microswitch 122 may be a conventional lever microswitch such as lever microswitch manufactured by Omron Tat si Electronics Co. of Japan.

Figure 4A:
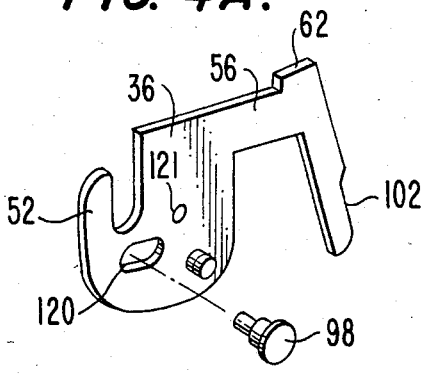
FIGS. 4A, 4B and 4C are perspective illustrations of the pivotable latch member in accordance with the present invention.
Figure 4B:
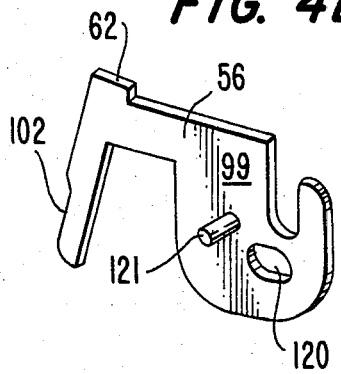
Figure 4C:
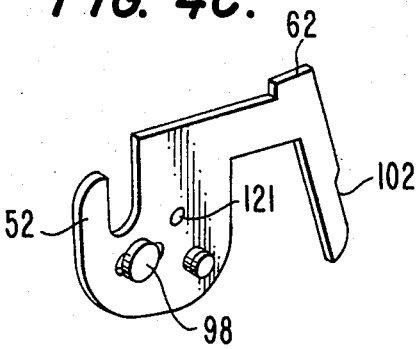
Figure 5A:
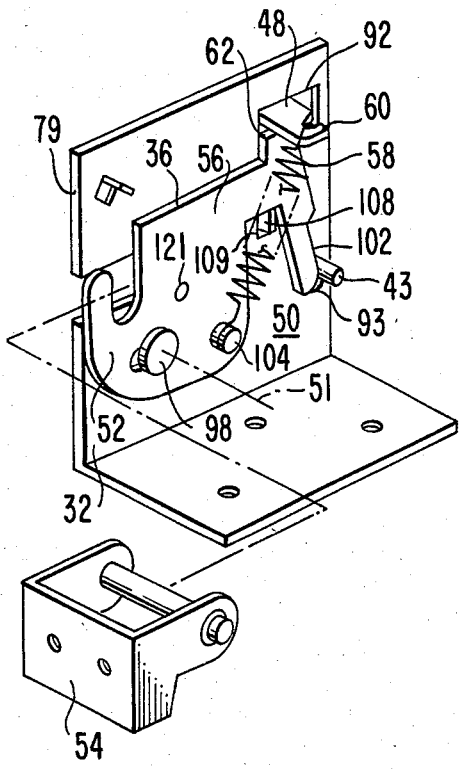
FIG. 5A is a partially exploded perspective view of one side of the compulsory switch activating latch in a locked position in accordance with the present invention.

Referring now to FIG. 5A, pivotal latch member 36 is pivotally mounted on the opposite vertical side 50 of bracket 32 for rotation about an axis 51 through rivet 98 parallel to axis 41 of the latch lever release arm 34. Pivotally latch member 36 includes a J-shaped hook portion 52 for engaging a fixed drawer tray latch member 54 mounted to the rear panel of drawer tray 14, and an extended portion 56 generally extending toward end portion 48 of the latch lever release arm 34. Referring also to FIGS. 4A through 4C, the pivotable latch 36 also has a horizontally elongated slot 120 below hook portion 52. Pivotable latch member 36 is pivotally mounted on side 50 by rivet 98 which extends through slot 120 along axis 51 and is fixed in a hole 100 in bracket 32 below the intersection of portions 88 and 90 of slot 84. Rivet 98 passes sufficiently loosely through slot 120 so as to permit pivotable latch member 36 to reciprocate horizontally of the slot on the rivet 98 as well as to pivot at either of the rounded ends of the slot.

Figure 5B:
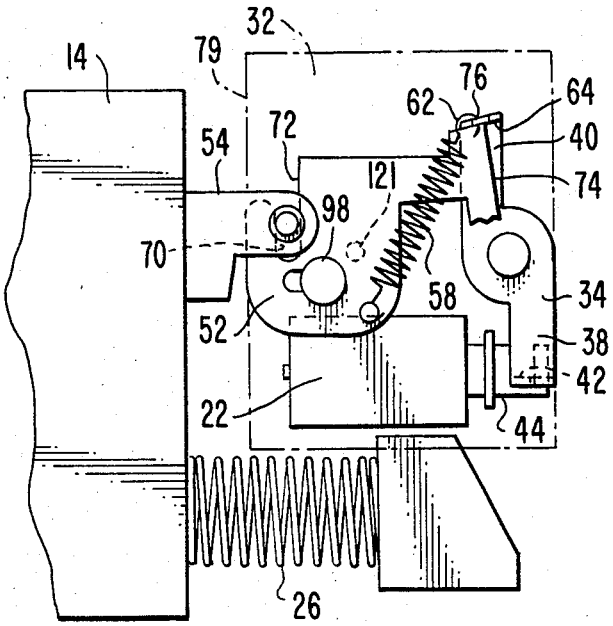
FIG. 5B is a schematic view of the latch assembly in accordance with the invention in the position shown in FIG. 5A, with parts removed for clarity.

Referring to FIGS. 4B and 6, the side 99 of pivotable latch member 36 facing side 50 of bracket 32 has a projecting pin 121 extending through the curved portion 90 of slot 84. The curved portion 90 is sufficiently long and wide to permit projecting pin 121 to freely pivot therein and horizontally reciprocate thereacross when the pivotable latch member 36 pivots respectively and reciprocates on the rivet 98 as described above. The pivotable latch member 36 also has a leg portion 102 extending downward from the free end of extended portion 56 generally to slot 93 in bracket 32. Referring to FIGS. 5A and 5B latching spring 58 is fixed at opposite ends to the tip 60 of the portion 48 of arm 34 and to a projection 104 fixed to side 50 of bracket 32 adjacent (below and behind) slot 120, and therefore adjacent the axis of rotation 51 of pivotable latch member 36 on the side of slot 120 closest to end portion 48 when end portion 48 is in engagement with pivotable latch member 36. Latching spring 58 serves to urge the top edge 62 of pivotable latch member 36 into flush engagement with the generally planar undersurface 64 of end portion 48 of latch lever release arm 34 as will be described below. Latching spring 58 has a much lesser biasing force than that of drawer opening spring 26.

Figure 9:
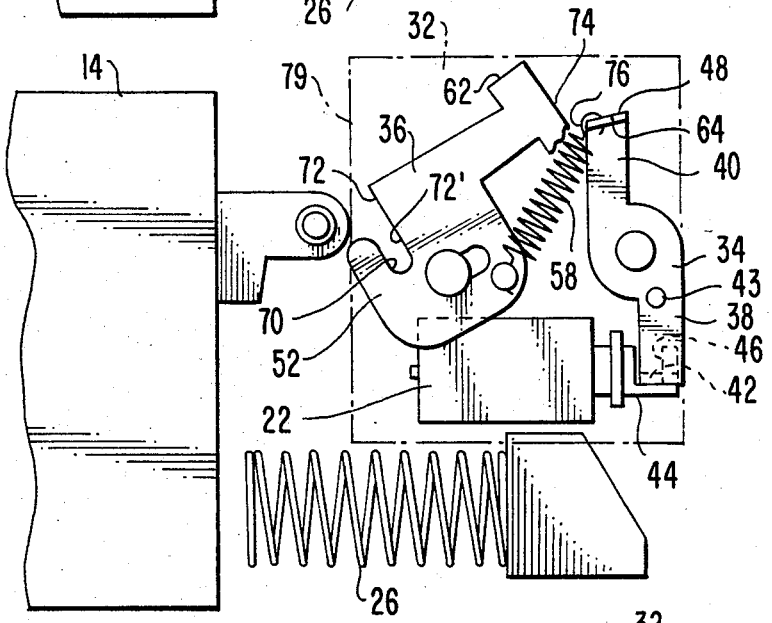

Latching spring 58 also serves to hold the upper opening in the hook portion 52 of the pivotable latch member 36 in a forwardly and downwardly pivoted orientation ultimately limited in its forward pivotable movement by engagement of the projection 95 with the extended portion 56, when the end portion 48 of latch lever release arm 34 is not in engagement with pivotable latch member 36 (see FIG. 9). Furthermore, the latching spring 58 biases the pivotable latch member 36 away from the front edge 79 of the bracket 32 so that the front end of the slot 120 engages the rivet 98 in the absence of an opposing force applied to the pivotable latch member 36.

Referring to FIG. 5B, which is a partially schematic illustration of portions of the invention with certain parts, including bracket 32 (shown in phanton line), microswitch 122, switching member 123, and leg portion 102, omitted for convenience of illustration, when the apparatus is in a closed drawer position prior to actuation of the solenoid 22, the undersurface 64 of end portion 48 of latch lever release arm 34 and top edge 62 of pivotable latch member 36 are angled so as to be flushed with each other. In this orientation, edge 62 is at an angle acute to lines long which extended portions 38 and 40 extend, so as to face the axis of rotation 41 of latch lever release arm 34.

Figure 7:
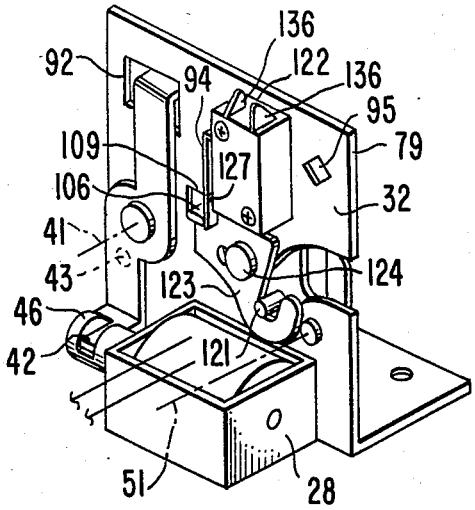
FIG. 7 is a perspective view of the compulsory switch activating latch taken from the same side as FIG. 6.

Referring again to FIGS. 6 and 7, a switching member 123 is mounted on side 30 of bracket 32 by a rivet 124 which extends through a horizontally extending slot 126 in the switching member 123 and a hole in bracket 32 so that the switching member 123 is horizontally reciprocally moveable thereon. The switching member 123 has a projection 106 which engages the side of microswitch lever 130 opposite that which engages the activating microswitch contact 127, and a projection 106 through the small slot 109 in bracket 32 (see FIGS. 3 and 13). Projection 108 serves to prevent pivotable movement of switching member 123 about rivet 124.

Switching member 123 also includes a J-shaped hook portion 110 at its forward end which is generally aligned with the curved portion 90 of slot 84, but with its inner front edge 112 rearward of the inner front edge of curved portion 90. Thus, the hook portion 110 and the curved portion 90 of slot 84 are so oriented that when the pivotable latch member 36 is in the orientation illustrated in FIG. 5A with the end portion 48 of latch lever release arm 34 engaged with the extended portion 56 of pivotable latch member 36, pin 121 projects into the hook portion 110 of switching member 123 so as to be engageable with the front edge 112 thereof. Thus, displacement of the pivotable latch member 36 in a forward direction toward edge 79 causes pin 121 to engage edge 112 and push thereagainst so as to displace the switching member 123 in a forward direction on the rivet 124. As indicated above, such movement of switching member 123 having its projection 106 in contact with lever 130 causes lever 130 to pivot forward against the bias of the internal spring means of activating switch contact 127.

The operation of the present invention may now be described with reference to FIGS. 5A, 5B and 7 through 13. Operation of the apparatus independently of the microswitch 122 and switching member 123 will first be explained with reference to FIGS. 5A and 8 through 10 in which microswitch 122, switching member 123 and bracket 32 are omitted for clarity. Referring to FIG. 5B, wherein the drawer tray 14 is in a closed position and the solenoid 22 is not energized, the latch lever release arm 34 extends generally vertically from solenoid plunger 44, which is in an outward position relative to solenoid 22, latch member 54 is in engagement with the rearwardly facing lower surface 70 of portion 52 of pivotable latch member 36, and drawer opening spring 26 is compressed against the rear panel of drawer tray 14 to that pivotable latch member 36 is held toward edge 79 (not shown in FIG. 5) in its outermost position relative to the rivet 98.

Figure 8:
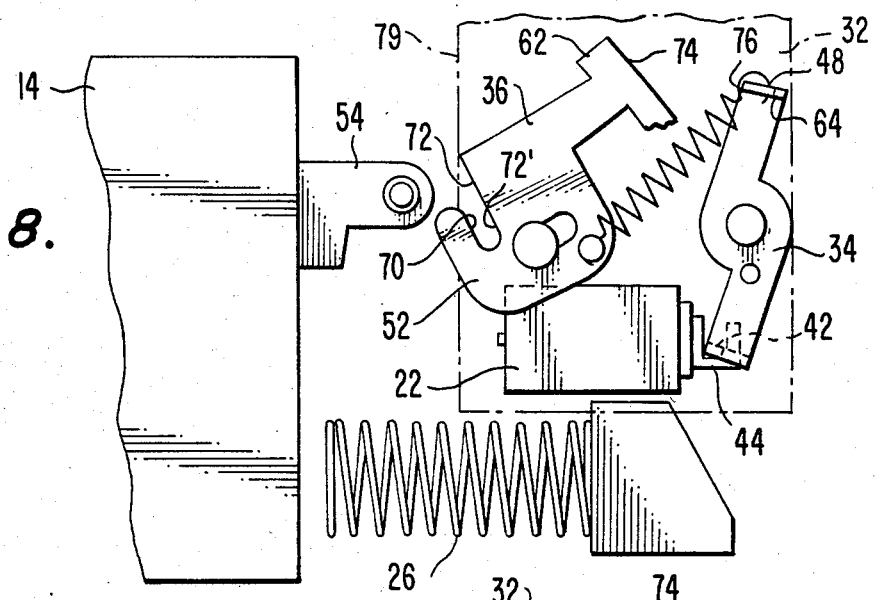
FIGS. 8 through 10 are schematic views of the latch assembly in accordance with the present invention in various stages of operation with parts removed for clarity.

Referring now to FIG. 8, the elements of the latching elements illustrated in FIG. 5B are schematically illustrated in the positions which they take after solenoid 22 has been energized to draw solenoid plunger 44 inward to release pivotable latch member 36 from drawer latch member 54 so that drawer opening spring 26 pushes drawer tray 14 out of casing 12 (casing 12 not being shown in FIG. 8). When solenoid plunger 44 is drawn into solenoid 22, latch lever release arm 34 is pivoted from the position shown in FIG. 5A to one in which the leftmost edge of under surface 64 engages the rightmost corner of top edge 62. As this occurs, drawer opening spring 26 begins to push drawer tray 14 outward whereby drawer latch member 54 rotates hook portion 52 downward with the bias of latch spring 58. Drawer opening spring 26 then continues to push drawer tray 14 out of casing 12. When opening spring 26 is separated from drawer tray 14, pivotable latch member 36 is urged away from front edge 79 on rivet 98 partly under the urging of latching spring 58.

When the solenoid 22 is deactivated, as illustrated in FIG. 9, solenoid 44 once again returns to an outward position, pivoting latch lever release arm 34 into an upright position and releasing the tension in latching spring 58, but with latch lever release arm 34 and pivotable latch member 36 maintained out of engagement.

Figure 10:
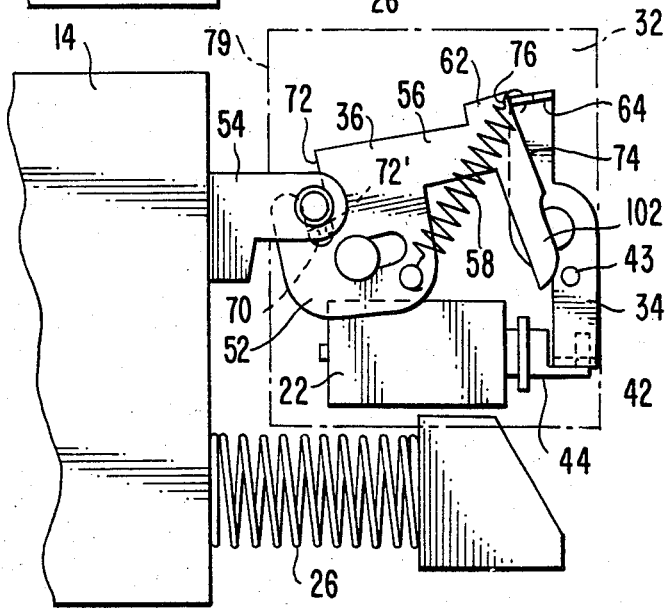

Referring to FIG. 10, when drawer tray 14 is manually pushed into casing 12, drawer tray latch member 54 engages the upper portion of the front facing surface 72 of hook portion 52 to pivot pivotable latch member 36 in a clockwise direction in FIG. 10. Latch member 54 slides "downward" relative to hook portion 52 into the space between the opposing hook portion inner surfaces 70 and 72'. During this clockwise rotation of pivotable latch member 36, an outside edge 74 of the pivotable latch member extended portion 56, which edge extends generally perpendicularly to upper edge 62, sliding engages the inside edge 76 of latch lever release arm engagement portion 48 to rotate latch lever release arm 34 slightly in a clockwise direction and slightly to expand latching spring 58. As the drawer continues to be moved forward, edge 76 of engagement portion 48 reaches the top end of outside 74. When the drawer tray 14 is no longer being manually pushed into the casing 12, latch lever release arm 34 will now snap back in a counter clockwise direction in response to the bias of latching spring 58 such that the engagement portion bottom surface 64 is in flush engagement with the upper edge 62 of pivotable latch member 36 to hold hook portion 52 of pivotable latch member 36 in secure engagement with drawer tray latch member 54 as illustrated in FIG. 5B. Also, once the engagement portion bottom surface 64 is in flush engagement with the upper edge 62 of pivotable latch member 36, meaning that the hook portion 52 thereof is in secure engagement with the drawer latch member 54, the opening spring 26 through the drawer tray latch member 54 draws the pivotable latch member 36 toward edge 79 and drawer tray 14 to its forwardmost position on rivet 98.

Also, as the pivotable latch member 36 is pivoted clockwise into a locked position, its leg portion 102 engages the pin 43 on the latch lever release arm 34 to pivot the latch lever release arm 34 in a counterclockwise direction in the event that the solenoid plunger 44 had previously become stuck in its inward position.

Figure 14:
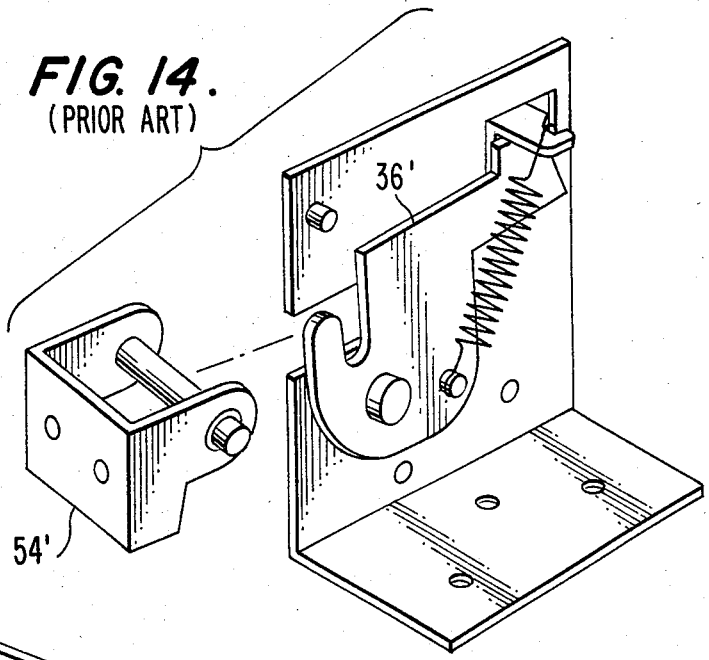
FIG. 14. (PRIOR ART)
FIGS. 14 and 15 are perspective views taken from opposite sides of a latch in accordance with the prior art.
Figure 15:
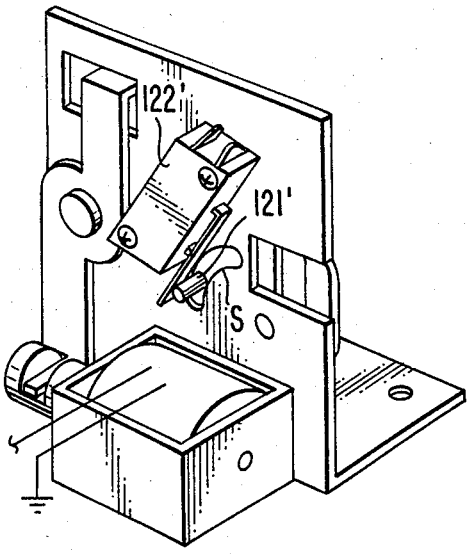
FIG. 15. (PRIOR ART)

Before explaining the operation of the microswitch and switching member in accordance with the preferred embodiment of the invention, the prior microswitch arrangement will be explained. FIGS. 14 and 15 illustrates a prior compulsory switch activating latch which includes the basic structure disclosed in applicants U.S. Pat. No. 4,424,426 referred to above. As is illustrated in FIG. 14, the pivotable latch member 36' is pivotably mounted to the bracket 32', but is not longitudinally displaceable. The pivotable latch member 36' has a projecting pin 121' extending through slot S as is illustrated in FIG. 15.

Pin 121' is directly engageable with the lever 130' of a microswitch 122' mounted angularly on the bracket 32' so that the lever 130' is pivoted inward to a closed position when the pivotable latch member 36' is pivoted clockwise in FIG. 14. Since the drawer tray latch member 54' pivots the pivotable latch member 36' when the drawer tray to which it is fixed is being pushed inward, but before the latch assembly is necessary completely closed, the microswitch is switched to a closed position before the pivotable latch member is actually in a locked condition. Thus, before the pivotable latch member is actually locked, but after the microswitch 122' has been switched to transmit a signal to a cash register computer that the drawer assembly is closed, the drawer tray can be opened, whereby the microswitch has given a false signal that the drawer assembly is closed. The present invention overcomes the possibility of such a false signal.

Figure 11:
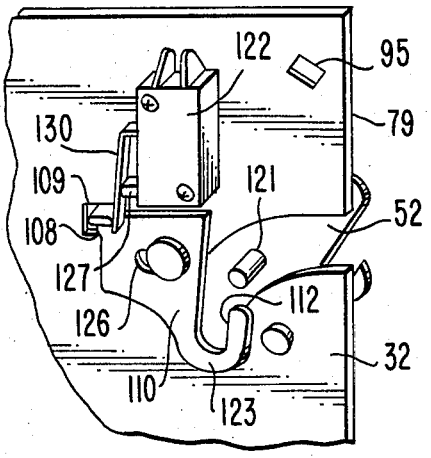
FIGS. 11 through 13 are enlarged perspective views of a portion of the compulsory switch activating latch illustrated in FIG. 7, at various stages of operation.

The operation of the microswitch 122 and switching member 123 in accordance with the invention to provide detection of complete closing of the drawer assembly is now described in detail with reference to FIGS. 11 through 13. When the drawer is open and the latch assembly is in the condition illustrated in FIGS. 8 or 9, the switching member 123 and microswitch 122 are in the positions illustrated in FIG. 11. Referring to FIG. 11, the microswitch contact 127 is in its outward position biasing the microswitch lever 130 and the switching member 123 therewith outward away from edge 79. The projecting pin 121 is fully outside and disengaged from the hook portion 110 of switching member 123.

Figure 12:
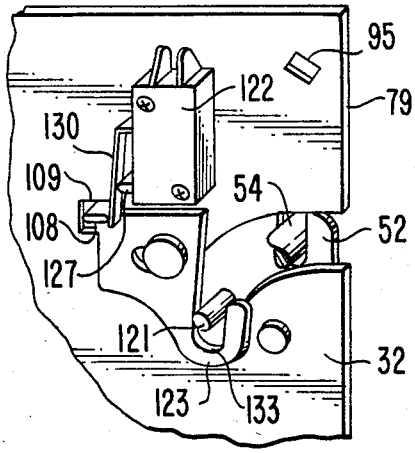

Referring to FIG. 12, when the drawer latch member 54 engages the forward facing edge 72 of pivotable latch member hook portion 52 as the drawer tray 14 is being closed, as illustrated in FIG. 10, projecting pin 121 is pivoted with pivotable latch member 36 into switching member hook portion 110. When engagement portion 48 of the latch lever release arm 34 is in firm engagement with the extended portion 56 of pivotable latch member 36 as illustrated in FIG. 5B, and the pivotable latch member 36 is displaced toward front edge 79 under the urging of opening spring 26 as illustrated in FIG. 5B, pin 121 engages edge 112 of hook portion 110 to displace switching member 123 forward in the direction of arrow 132 toward edge 79 to its forwardmost position against the bias of the spring means of switch contact 127 and latching spring 58 to pivot the microswitch lever 130 and thereby push the switch contact 127 to its inward position which is illustrated in FIG. 13.

Figure 13:
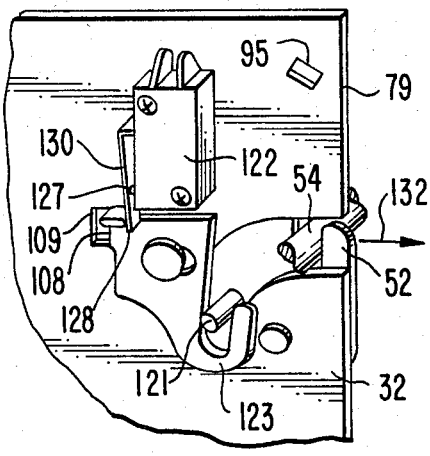

So long as the drawer assembly is latched closed, the microswitch 122 will be held in the closed position shown in FIG. 13. However, as the solenoid 22 is energized to detach pivotable latch member 36 and latch lever release arm 34, the pivotable latch member 36 will pivot to the position shown in FIG. 8 thereby pivoting the pin 121 out of the switching member hook portion 110. The switching member 123 is thereby released to be returned to its rearward position illustrated in FIG. 11 under the bias of the internal spring means of microswitch contact 127.

If the microswitch is electrically connected through terminals 136 to a computerized cash register as indicated above, the cash register will record the opening and closing of the drawer assembly as detected by the microswitch 122.

It will be appreciated by those skilled in the art to which this invention pertains that although only a single exemplary embodiment of the invention has been hereinabove described, there are many modification which may be made fully within the scope of the invention, which is limited only by the appended claims.

What is claimed is:

1. A compulsory switch activating latch for being fixed to a fixed frame with respect to which a moveable frame is reciprocally displaceable toward and away, and biased away by a spring, said latch comprising:

a bracket for being fixed to the fixed frame;

a first pivotable latch member pivotally mounted to said bracket for pivotal movement about a first mounting axis between first and second rotational positions and reciprocal movement in opposite first and second longitudinal directions between first and second longitudinal positions, with respect to said bracket, said first mounting axis being fixed with respect to one of said first pivotable latch member and said bracket and extending perpendicularly to said first and second longitudinal directions; and first pivotable latch member having a first hook position for engagement with a fixed latch member fixed to the moveable frame when said first pivotable latch member is in said first rotational position, to hold the moveable frame to the fixed frame, said first hook portion having a J-shaped edge having a top edge portion generally facing in said first longitudinal direction at the top of said J-shaped edge and a bottom edge portion generally facing in said second longitudinal direction such that a force in said second longitudinal direction applied to said top edge portion while said first pivotable latch member is in said second rotational position pivots said first pivotable latch member from said second rotational position to said first rotational position, and a force in said first longitudinal direction applied to said bottom edge portion while said first pivotable latch member is in said first longitudinal position urges said first pivotable latch member from said first longitudinal position toward said second longitudinal position;

means, responsive to movement of said first pivotable latch member from said second rotational position to said first rotational position, for releasably locking said first pivotable latch member in a locked condition in said first rotational position with said fixed latch member held in said first hook portion;

first spring means for resiliently biasing said first pivotable latch member toward said second longitudinal position;

means for releasing said first pivotable latch member from said locked condition; and means for detecting displacement of said first pivotable latch member from said first longitudinal position to said second longitudinal positions and from said second longitudinal position to said first longitudinal position.

2. A latch as in claim 1, wherein said detecting means includes a switching member mounted to said bracket, reciprocally movable between a first switching position and a second switching position, means for detecting displacement of said switching member from said first switching position to said second switching position and for detecting displacement of said switching member from said second switching position to said first switching position, second spring means for biasing said switching member toward said second switching position and an engaging member fixed at one end to one of said switching member and said first pivotable latch member, located so as to engage the other of said switching member and said first pivotable latch member and displace said switching member from said second switching position to said first switching position against the bias of said second spring means with displacement of said first pivotable latch member from said first longitudinal position to said second longitudinal position when said first pivotable latch member is in said locked condition, and so as to disengage from said other of said switch member and said first pivotable latch member when said first pivotable latch member pivots from said first rotational position to said second rotational position.

3. A latch as in claim 2, wherein said bracket has a first side, a second side opposite said first side and a slot therein extending from said first side to said second side; said first pivotable latch member being pivotally mounted to said bracket on said first side, said switching member being mounted to said bracket on said second side, said engaging member comprising a projection fixed at one end to said one of said switching member and said first pivotable latch member and being engagable at the other end thereof with an engaging edge of said other of said switching member and said first pivotable latch member.

4. A latch as in claim 3, wherein said switching member comprises a second hook portion having said engaging edge therein, said projection being fixed to said first pivotable latch member and extending into said second hook portion when said first pivotable latch member is in said locked condition so as to push said switching member therewith when said first pivotable latch member is moved in said first longitudinal direction from said first longitudinal position toward said second longitudinal position, such that said projection pivots out of said second hook portion when said first pivotable latch member is pivoted from said first rotational position to said second rotational position.

5. A latch as in claim 3, wherein said detecting means comprises a lever microswitch having a lever pivotable between a first lever position and a second lever position and means for resiliently biasing said lever toward said second lever position, said switching member being engagable with said lever to pivot said lever against the bias of said lever biasing means from said second lever position to said first lever position when said switching member is moved from said second switching position to said first switching position, said second spring means including said lever biasing means.

6. A latch as in claim 4, wherein said first pivotable latch member has a first extended portion radially extending from said first mounting axis;

said releasing means comprising a solenoid fixed to said bracket on said second side and means, electrically capable of being coupled to said solenoid, for energizing said solenoid in response to an applied DC voltage;

said releasably locking means including a second pivotable latch member pivotally mounted to said bracket on said second side for rotation about a second mounting axis, having a second extended portion extending generally radially outwardly from said second mounting axis and engagable at an end thereof spaced from said second mounting axis with an end of said first extended portion spaced from said first mounting axis, and a spring coupling said first and second portions so as to be bias said first and second extended portions into engagement when said first pivotable latch member is in said first rotational position, said spring comprising said first spring means, said releasing means further comprising means, responsive to energization of said solenoid by the DC voltage, for rotating said second extended portion about said second mounting axis so as to disengage said first extended portion from said second extended portion.

7. A latch as in claim 1, wherein said first mounting axis is fixed with respect to said bracket, said latch further comprising a mounting pin fixed to said bracket and extending along said first mounting axis, said first pivotable latch member having an elongated slot having a length oriented so as to extend in said first and second longitudinal directions, said pin extending through said elongated slot so that said first pivotable latch member is movable along the length of said slot.

8. An apparatus, comprising:

a first frame member;

a second frame member movable in opposite first and second longitudinal directions respectively toward and away from said first frame member;

a fixed latch member fixed to said second frame member;

a first pivotable latch member pivotally mounted to said first frame member for pivotal movement about a first mounting axis between first and second rotational positions and reciprocal movement in said first and second longitudinal directions between first and second longitudinal positions with respect to said casing, said first mounting axis being fixed with respect to one of said first pivotable latch member and said first frame member and extending perpendicularly to said first and second longitudinal directions; said first pivotable latch member having a first hook portion engagable with said fixed latch member when said first pivotable latch member is in said first rotational position to hold said second frame member adjacent said first frame member, said fixed latch member being longitudinally movable with said second frame member into contact with said first hook portion so as to pivot said first pivotable latch member from said second rotational position to said first rotational position;

means, responsive to movement of said first pivotable latch member from said second rotational position to said first rotational position, for releasably locking said first pivotable latch member in a locked condition in said first rotational position with said fixed latch member held in said first hook portion;

first spring means for resiliently biasing said first pivotable latch member toward said second longitudinal position;

means for releasing said first pivotable latch member from said locked condition;

second spring means for displacing said first pivotable latch member in said second longitudinal direction from said second longitudinal position to said first longitudinal position when said first pivotable latch member is locked in said locked condition in said first rotational position and said fixed latch member is locked in said first hook portion, by resiliently urging said fixed latch member in said second longitudinal direction, said second spring means including means for resiliently urging said second frame member and said fixed latch member in said first longitudinal direction when said first pivotable latch member is released from said locked condition by said releasing means, so as to pivot said first pivotable latch member from said first rotational position to said second rotational position to disengage said fixed latch member from said first hook portion and urge said second frame member away from said first frame member;

detecting means for detecting displacement of said first pivotable latch member from said first longitudinal position to said second longitudinal position and for detecting displacement of said first pivotable latch member from said second longitudinal position to said first longitudinal position.

9. An apparatus as in claim 8, wherein said detecting means includes:

a switching member mounted to said first frame member, reciprocally movable between a first switching position and a second switching position;

means for detecting displacement of said switching member from said first switching position to said second switching position and for detecting displacement of said switching member from second switching position to said first switching position;

third spring means for resiliently biasing said switching member toward said second switching position; and an engaging member fixed to one of said switching member and said first pivotable latch member located so as to engage the other of said switching member and said first pivotable latch member and displace said switching member from said second switching position to said first switching position against the bias of said third spring means with displacement of said first pivotable latch member from said first longitudinal position to said second longitudinal position when said first pivotable latch member is in said locked condition, and so as to disengage from said other of said switching member and said first pivotable latch member when said first pivotable latch member pivots from said first rotational position to said second rotational position.

10. An apparatus as in claim 9, further comprising a bracket fixed to said casing, having a first side, a second side opposite said first side, and a slot therein extending from said first side to second side; said first pivotable latch member being pivotally mounted to said bracket on said first side, said switching member being mounted to said bracket on said second side, said engaging member comprising a projection fixed at one end to said one of said switching member and said first pivotable latch member and being engagable at the other end thereof with an edge of said other of said switching member and said first pivotable latch member.

11. An apparatus as in claim 10, wherein said switching member has a second hook portion having said edge therein, said projection being fixed to said first pivotable latch member, and extending into said second hook portion when said first pivotable latch member is in said locked condition so as to push said switching member therewith when said first pivotable latch member is moved in said first longitudinal direction from said first longitudinal position toward said second longitudinal position, such that said projection pivots out of said second hook portion when said first pivotable latch member is pivoted from said first rotational position to said second rotational position.

12. An apparatus as in claim 10, wherein said detecting means comprises a lever microswitch having a lever pivotable between a first lever position and a second lever position and means for resiliently biasing said lever toward said second lever position, said switching member being engagable with said lever to pivot said lever against the bias of said lever biasing means from said second lever position to said first lever position when said switching member is moved from said second switching position to said first switching position, said third spring means including said lever biasing means.

13. An apparatus as in claim 11, wherein said first pivotable latch member has a first extended portion radially extending from said first mounting axis;

said releasing means comprising a solenoid fixed to said bracket on said second side, and means, electrically capable of being coupled to said solenoid, for energizing said solenoid in response to an applied DC voltage;

said releasably locking means including a second pivotable latch member pivotally mounted to said bracket on said second side for rotation about a second mounting axis, having a second extended portion extending generally radially outwardly from said second mounting axis and engagable at an end thereof spaced from said second mounting axis with an end of said first extended portion spaced from said first mounting axis, and a spring coupling said first and second extended portions so as to bias said first and second extended portions into engagement when said first pivotable latch member is in said first rotational position, said spring comprising said first spring means, said releasing means further comprising means, responsive to energization of said solenoid by the DC voltage, for rotating said second extended portion about said second mounting axis so as to disengage said first extended portion from said second extended portion.

14. An apparatus as in claim 8, wherein said first frame member comprises a casing, said second frame member comprises a drawer tray slidable in said opposite first and second directions into and out of said casing, said fixed latch member is fixed to said drawer tray, and said first pivotable latch member is pivotally mounted to said casing.

15. A drawer assembly, comprising:

a casing;

a drawer tray slidably in opposite first and second longitudinal directions respectively into and out of said casing;

a fixed latch member fixed to said drawer trays;

a first pivotable latch member pivotally mounted to said casing for pivotal movement about a first mounting axis between first and second rotational positions and reciprocal movement in said first and second longitudinal directions between first and second longitudinal positions, with respect to said casing; said first mounting axis being fixed with respect to one of said first pivotable latch member and said casing and extending perpendicularly to said first and second longitudinal directions; said first pivotable latch member having a first hook portion engageable with said fixed latch member when said first pivotable latch member is in said first rotational position to hold said drawer tray inside said casing; said fixed latch member being longitudinally movable with said drawer tray into contact with said first hook portion so as to pivot said first pivotable latch member from said second rotational position to said first rotational position;

means, responsive to movement of said first pivotable latch member from said second rotational position to said first rotational position, for releasably locking said first pivotable latch member in a locked condition in said first rotational position with said fixed latch member held in said first hook portion;

first spring means for resiliently biasing said first pivotable latch member toward said second longitudinal position;

means for releasing said first pivotable latch member from said locked condition;

second spring means for moving said first pivotable latch member in said second longitudinal direction from said second longitudinal position to said first longitudinal position when said first pivotable latch member is locked in said locked condition in said first rotational position and said fixed latch member is locked in said first hook portion, by resiliently urging said fixed latch member in said second longitudinal direction, said second spring means including means for resiliently urging said drawer tray and said fixed latch member in said first longitudinal direction when said first pivotable latch member is released from said locked condition by said releasing means, so as to pivot said first pivotable latch member from first rotational position to said second rotational position to disengage said fixed latch member from said first hook portion and urge said drawer tray out of said casing;

a switching member mounted to said casing, reciprocally movable between a first switching position and a second switching position;

means for detecting displacement of said switching member from said first switching position to said second switching position and for detecting displacement from said second switching position to said first switching position;

third spring means for biasing said switching member toward said second switching position; and an engaging member fixed to one of said switching member and said first pivotable latch member, located so as to engage the other of said switching member and said first pivotable latch member and displace said switching member from said second switching position to said first switching position against the bias of said third spring means with displacement of said first pivotable latch member from said first longitudinal position to said second longitudinal position when said first pivotable latch member is in said locked condition, and so as to disengage from said other of said switching member and said first pivotable latch member when said first pivotable latch member pivots from said first rotational position to said second rotational position.

16. A device for releasably locking a drawer tray in a casing having a drawer spring biasing the drawer tray in a first direction out of the casing, said device comprising:

means, mountable in the casing, for releasably locking the latch bar therein in response to movement of the latch bar in a second longitudinal direction opposite the first longitudinal direction to a predetermined bar position, said locking means including a movable latch member reciprocally movable in said first and second longitudinal directions between a first latch position and a second latch position;

spring means resiliently biasing said movable latch member in said second direction toward said first latch position, said releasably locking means including means for positioning said movable latch member in locking engagement with the latch bar in response to said movement of the latch bar to said predetermined bar position and so as to be movable with the latch bar to said second latch position against the bias of said spring means in response to force applied thereto by the drawer spring through the drawer tray and the latch bar; and means for detecting movement of said movable latch member from said first latch position to said second latch position

* * * * *